US008887694B2

(12) United States Patent
Hada et al.

(10) Patent No.: US 8,887,694 B2
(45) Date of Patent: Nov. 18, 2014

(54) FUEL PUMP DRIVING STRUCTURE AND INTERNAL COMBUSTION ENGINE

(75) Inventors: Masatoshi Hada, Nagoya (JP); Naonori Kinoshita, Nagoya (JP); Miyuki Yamazaki, Nagoya (JP); Tsuneo Mitsuhashi, Nagoya (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 0 days.

(21) Appl. No.: 14/241,486

(22) PCT Filed: Sep. 9, 2011

(86) PCT No.: PCT/JP2011/005080

§ 371 (c)(1),
(2), (4) Date: Feb. 27, 2014

(87) PCT Pub. No.: WO2013/035137

PCT Pub. Date: Mar. 14, 2013

(65) Prior Publication Data

US 2014/0190454 A1 Jul. 10, 2014

(51) Int. Cl.

| | |
|---|---|
| ***F02M 37/06*** | (2006.01) |
| ***F02M 39/02*** | (2006.01) |
| ***F02F 1/24*** | (2006.01) |
| ***F02F 7/00*** | (2006.01) |
| ***F01L 1/46*** | (2006.01) |
| ***F02M 59/44*** | (2006.01) |
| *F04C 29/00* | (2006.01) |
| *F01L 1/053* | (2006.01) |

(52) U.S. Cl.

CPC ..... *F02M 39/02* (2013.01); *F04C 29/005* (2013.01); *F02F 1/24* (2013.01); *F02F 7/006* (2013.01); *F01L 1/46* (2013.01); *F01L 2001/0535* (2013.01); *F02M 59/44* (2013.01)

USPC ..... 123/508; 123/495; 417/374

(58) Field of Classification Search

CPC ... F02M 59/102; F02M 39/02; F02M 57/022; F02M 57/023; F01L 1/46; F01L 1/047; F01L 1/053; F04C 29/0042; F04C 29/005; F04C 29/0057; F04C 29/0092

USPC ..... 123/495, 508, 90.27, 90.6; 417/364, 417/374

See application file for complete search history.

(56) References Cited

U.S. PATENT DOCUMENTS 4,662,320 A * 5/1987 Moriya ..... 123/41.44
5,626,121 A 5/1997 Kushida et al.

(Continued)

FOREIGN PATENT DOCUMENTS

GB 2140083 A 11/1984
JP 2003-184688 A 7/2003

(Continued)

*Primary Examiner* — Thomas Moulis
(74) *Attorney, Agent, or Firm* — Global IP Counselors

(57) ABSTRACT

The fuel pump driving structure includes a camshaft and a pump cam member. The camshaft is rotatably supported at an end by a cylinder head. The pump cam member has a fitting hole into which the end of the camshaft is press fitted, and is operatively coupled to a high-pressure fuel pump. The pump cam member includes a pump cam section and a first contact section. The pump cam section has a first lift portion operating the high-pressure fuel pump, and a base circular portion that does not operate the high-pressure fuel pump. The first contact section is in a position offset from a position of the first lift portion with respect to a circumferential direction and contacting a portion of the camshaft in an axial direction at a position radially outward of an external circumferential surface of the one end of the camshaft.

16 Claims, 14 Drawing Sheets

(56) References Cited

U.S. PATENT DOCUMENTS

| | | | | |
|---|---|---|---|---|
| 5,899,181 | A * | 5/1999 | Kurata et al. | 123/90.17 |
| 6,148,787 | A * | 11/2000 | Takano | 123/195 A |
| 6,895,942 | B2 * | 5/2005 | Iitaka et al. | 123/509 |
| 6,976,476 | B1 * | 12/2005 | Mantri | 123/508 |
| 7,765,989 | B2 * | 8/2010 | Maruyama | 123/508 |
| 8,166,935 | B2 * | 5/2012 | Eiraku et al. | 123/90.17 |
| 8,307,799 | B2 * | 11/2012 | Shin | 123/90.33 |
| 8,434,458 | B2 * | 5/2013 | Asari et al. | 123/508 |
| 2003/0145835 | A1 | 8/2003 | Djordjevic | |
| 2008/0230036 | A1 * | 9/2008 | Bauman et al. | 123/508 |
| 2011/0139125 | A1 * | 6/2011 | Tisch | 123/495 |

FOREIGN PATENT DOCUMENTS

| | | | |
|---|---|---|---|
| JP | 2005-133618 | A | 5/2005 |
| JP | 2010-112256 | A | 5/2010 |

* cited by examiner

FUEL PUMP DRIVING STRUCTURE AND INTERNAL COMBUSTION ENGINE

CROSS-REFERENCE TO RELATED APPLICATIONS

This application is a U.S. National Stage of International Application No. PCT/JP2011/005080, filed Sep. 9, 2012.

BACKGROUND

1. Field of the Invention

The present invention relates to a fuel pump driving structure and an internal combustion engine and to an internal combustion engine equipped with the fuel pump driving structure.

2. Background Information

A conventional fuel pressuring apparatus for an internal combustion engine has been proposed which drives a high-pressure fuel pump with a pump cam provided on one end of a camshaft that extends in an axial direction (see Japanese Laid-Open Patent Publication No. 2003-184688). With this conventional apparatus, the pump cam can be supported in a cantilever fashion because the high-pressure fuel pump is arranged near an end wall of a cylinder head and, thus, the apparatus can be made more compact. However, in recent years, increasingly higher fuel pressures have been demanded of high-pressure fuel pumps in order to achieve improved fuel efficiency. Consequently, in order to improve the durability of the pump cam, there are a demand for the pump cam to be treated in a special quenching process and a demand for the pump cam to be made of a material having a high resistance to wear. Therefore, a structure in which the pump cam and the camshaft are fabricated as separate members and the pump cam is press fixed to the camshaft by press fitting has been proposed (see Japanese Laid-Open Patent Publication No. 2005-133618).

Since the pump cam and the camshaft are formed as separate entities, the pump cam can be treated with a special quenching process and the pump cam can be made of a material having a high resistance to wear so as to improve the durability of the pump cam. Additionally, the apparatus can be made more compact because the pump cam, the camshaft, and the cam journal can be arranged in close proximity to one another. However, since a diameter of the camshaft at a portion where the pump cam is press fitted onto the camshaft is limited by the size of the pump cam, it is necessary to design the diameter of the camshaft at the portion where the pump cam is press fitted onto the camshaft to accommodate the limitation. As a result, there are situations in which the strength of the camshaft is insufficient with respect to bending input from the pump cam.

SUMMARY

Therefore, one object of the present invention is to provide a fuel pump driving structure that improves a durability of a camshaft and a pump cam member while also making a fuel pressuring apparatus more compact. In order to achieve this object at least partially, a fuel pump driving structure is configured to drive a high-pressure fuel pump of an internal combustion engine. The fuel pump driving structure includes a camshaft and a pump cam member. The camshaft is configured and arranged to be rotatably supported at an end by a cylinder head of the internal combustion engine. The pump cam member has an internal circumference surface defining a fitting hole into which the end of the camshaft is press fitted, and configured to be operatively coupled to the high-pressure fuel pump to drive the high-pressure fuel pump. The pump cam member includes a pump cam section and a first contact section. The pump cam section has a first lift portion configured to operate the high-pressure fuel pump, and a base circular portion configured to not operate the high-pressure fuel pump. The first contact section is arranged in a position offset from a position of the first lift portion with respect to a circumferential direction and contacting a portion of the camshaft in an axial direction of the camshaft at a position radially outward of an external circumferential surface of the one end of the camshaft

BRIEF DESCRIPTION OF DRAWINGS

Referring now to the drawings which form a part of this original disclosure.

DETAILED DESCRIPTION OF THE EMBODIMENTS

Selected embodiment will now be explained with reference to the drawings. It will be apparent to those skilled in the art from this disclosure that the following descriptions of the embodiments are provided for illustration only and not for the purpose of limiting the invention as defined by the appended claims and their equivalents.

First Embodiment

Figure 1:
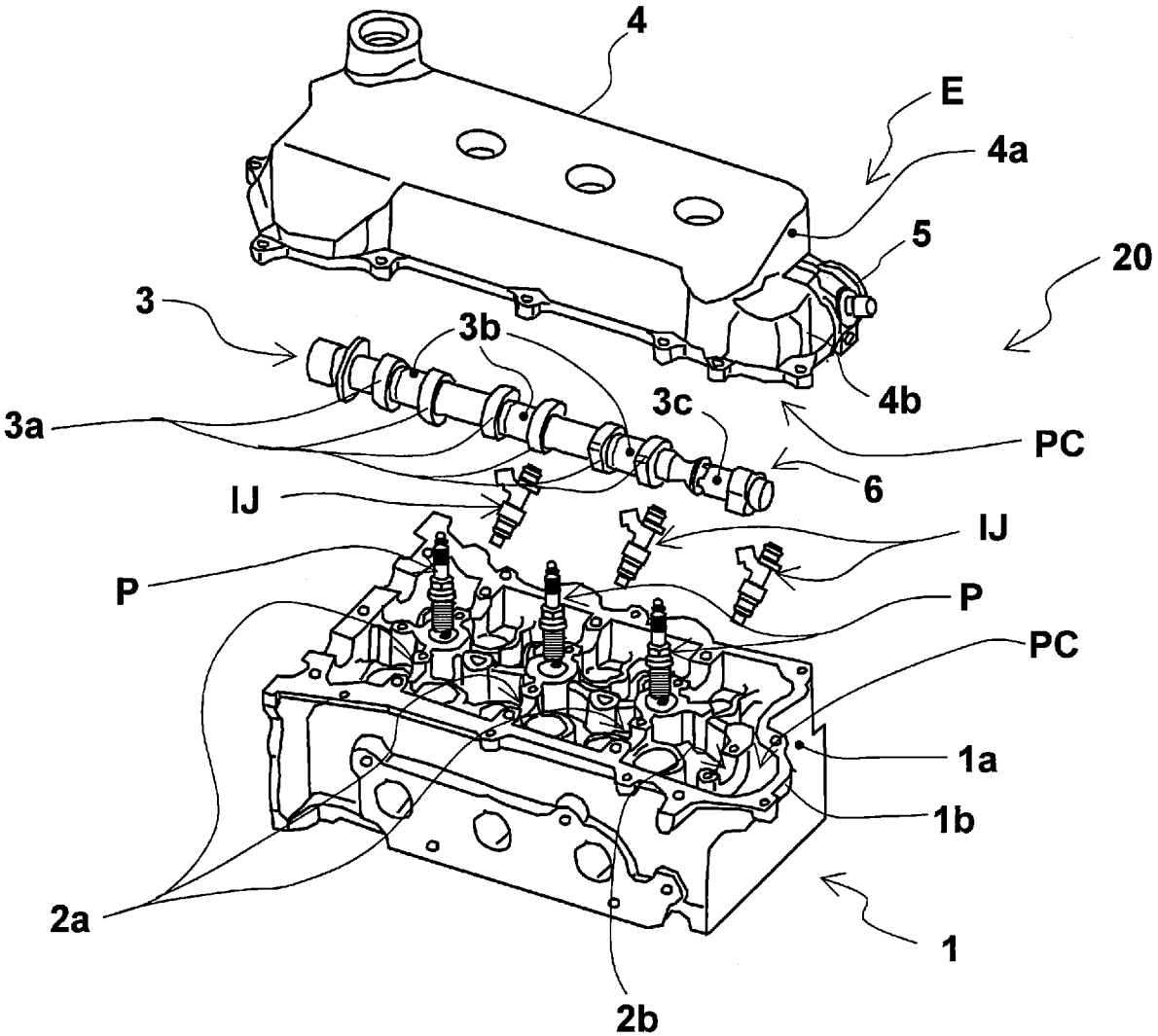
FIG. 1 is a schematic view showing an engine equipped with a fuel pressurizing apparatus according to one embodiment of the present invention.

Referring initially to FIG. 1, a fuel pressurizing apparatus equipped with a fuel pump driving structure is illustrated in accordance with a first embodiment. FIG. 1 is a schematic view showing an engine E equipped with a fuel pressurizing apparatus 20 with a fuel pump driving structure according to an embodiment of the present invention. An engine E equipped with a fuel pressurizing apparatus 20 according to this embodiment is, for example, an internal combustion engine configured to generate an output power using gasoline, diesel fuel, or other hydrocarbon based fuel. Cleaned intake air and gasoline injected from a fuel injector IJ are mixed to form an air-fuel mixture and the air-fuel mixture is drawn into a combustion chamber (not shown). A spark plug P generates an electric spark to ignite the air-fuel mixture and cause the air-fuel mixture to combust explosively. The energy of the combustion pushes a piston downward and a reciprocal motion of the piston is converted into rotational motion of a crankshaft (not shown). As shown in the figure, the fuel pressurizing apparatus 20 according to this embodiment comprises a high-pressure fuel pump 5 attached to an end wall 4*a* of a head cover 4 that faces along a direction in which cylinders are arranged, a camshaft 3 rotatably supported on a cylinder head 1, and a pump cam member 6 fixed by press fitting onto one axial end of the camshaft 3. The camshaft 3 and the pump cam member 6 are covered with a head cover 4 attached to an upper portion of the cylinder head 1. The camshaft 3 and the pump cam member 6 preferably constitute the fuel pump driving structure of this embodiment.

A chamber forming section 4*b* serving to form a pump cam chamber PC is provided on the end wall 4*a* of the head cover 4 and configured to protrude outward (rightward in FIG. 1) beyond the end wall 4*a*. The high-pressure fuel pump 5 is fixed with bolts to the chamber forming section 4*b*.

The high-pressure fuel pump 5 is a known high-pressure fuel pump configured to pressurize pressurized fuel even further by reciprocally moving a plunger (not shown) and supply the fuel to a fuel injector (not shown). The high-pressure fuel pump 5 is a conventional component that is well known in the art. Since the high-pressure fuel pump 5 is well known in the art, the structure will not be discussed or illustrated in detail herein for the sake of brevity.

A plurality of camshaft bearing sections 2*a* for rotatably supporting the camshaft 3 are formed on the cylinder head 1. A chamber forming section 1*b* serving to form a pump cam chamber PC is provided on an end wall 1*a* of the cylinder head 1 (an end facing along a direction in which the cylinders are arranged) and configured to protrude outward (rightward in FIG. 1) beyond the end wall 1*a*. Among the camshaft bearing sections 2*a*, a camshaft bearing section 2*b* positioned closest to a pump cam chamber PC is formed inside the chamber forming section 1*b* in a position (along an extension line of the end wall 1*a*) corresponding to the end wall 1*a*. In other words, as shown in FIG. 1, the pump camshaft bearing section 2*b* is aligned along a planar direction of the end wall 1*a*.

Figure 2:
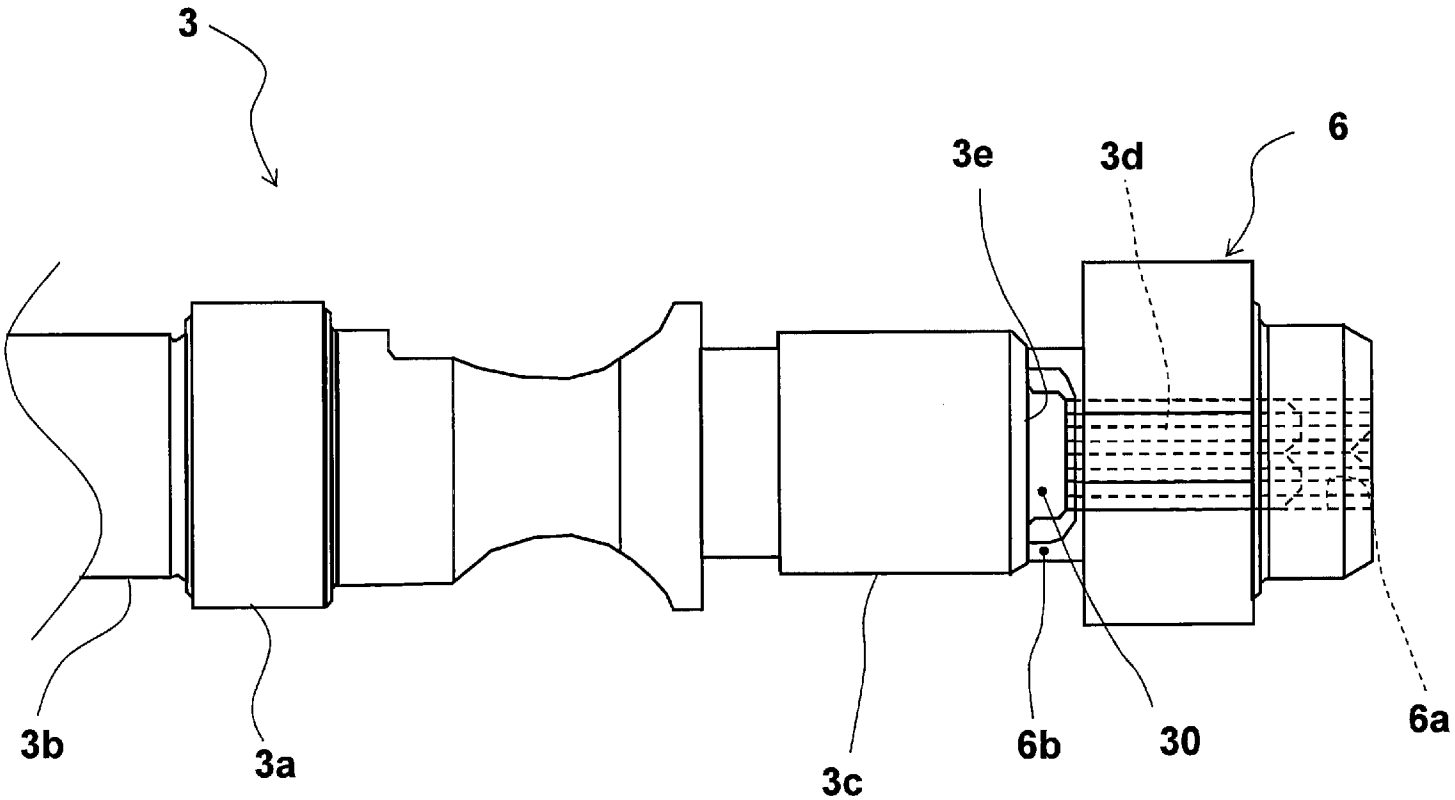
FIG. 2 is an enlarged schematic view showing a fuel pump driving structure where a pump cam member is integrally joined to tip end of a camshaft according to the illustrated embodiment.
Figure 3:
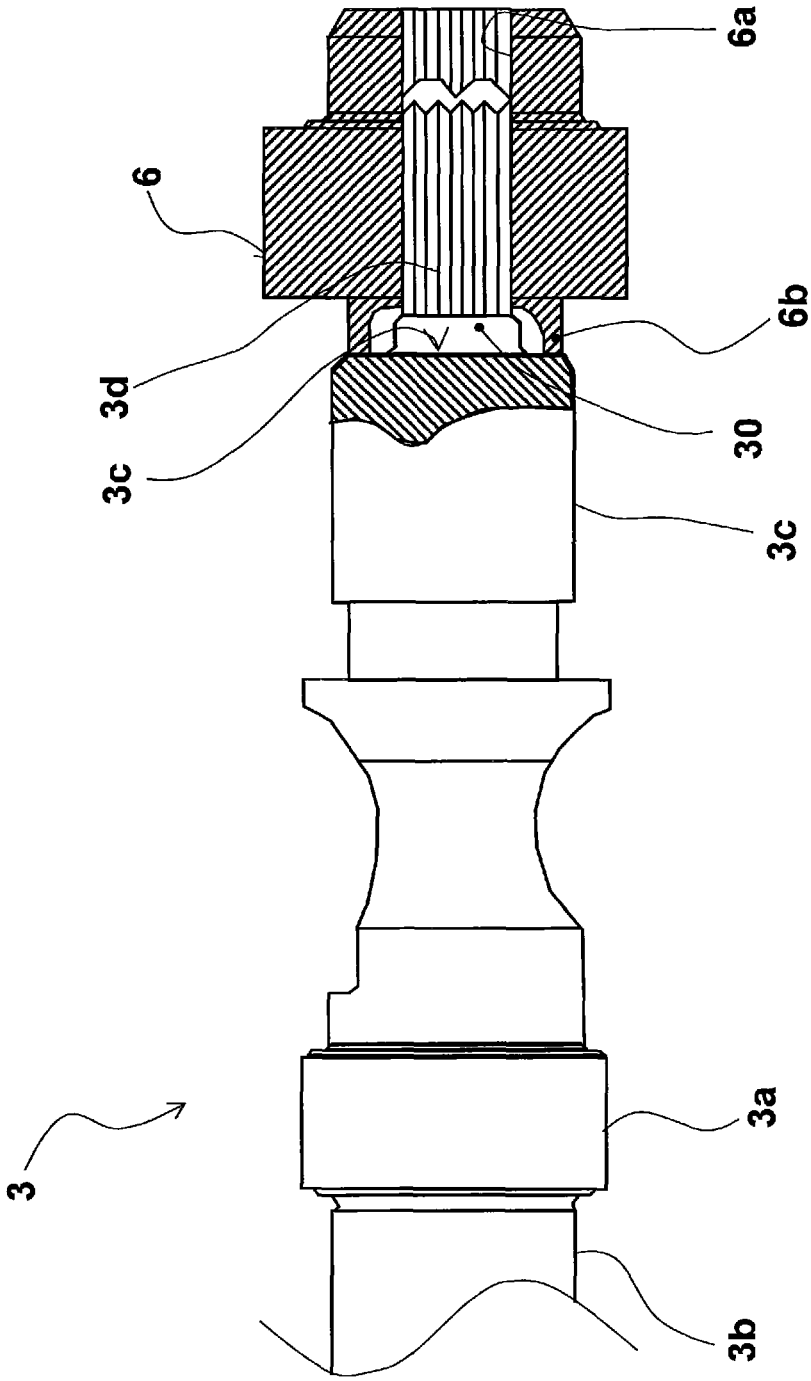
FIG. 3 is an enlarged schematic view corresponding to FIG. 2 in which the pump cam member is partially illustrated with a cross sectional view according to the illustrated embodiment.

FIG. 2 is an enlarged view showing a portion of the camshaft 3 onto which the pump cam member 6 is fixed by press fitting, and FIG. 3 is the same as FIG. 2 except that a portion is shown with a cross sectional view. As shown in FIGS. 1, 2 and 3, the camshaft 3 comprises a plurality of cams 3*a* for opening and closing intake valves (not shown) and exhaust valves (not shown), a camshaft journal section 3*b* supported on the camshaft bearing sections 2*a*, a camshaft journal section 3*c* formed at one axial end of the camshaft 3 and supported on the camshaft bearing section 2*b*, and an extended section 30 that is formed integrally with a smooth transition on one axially facing end of the camshaft journal section 3*c* (right-hand end in FIGS. 2 and 3). The pump cam member 6 is press fitted onto the extended section 30 so as to be coaxial with respect to the camshaft 3. The extended section 30 has an axial spline section 3*d* that has a smaller diameter than the camshaft journal section 3*c* and has splines (spline protrusions) formed on an external circumferential surface thereof. The camshaft 3 is preferably made of cast iron, e.g., nodular graphite cast iron.

Figure 4:
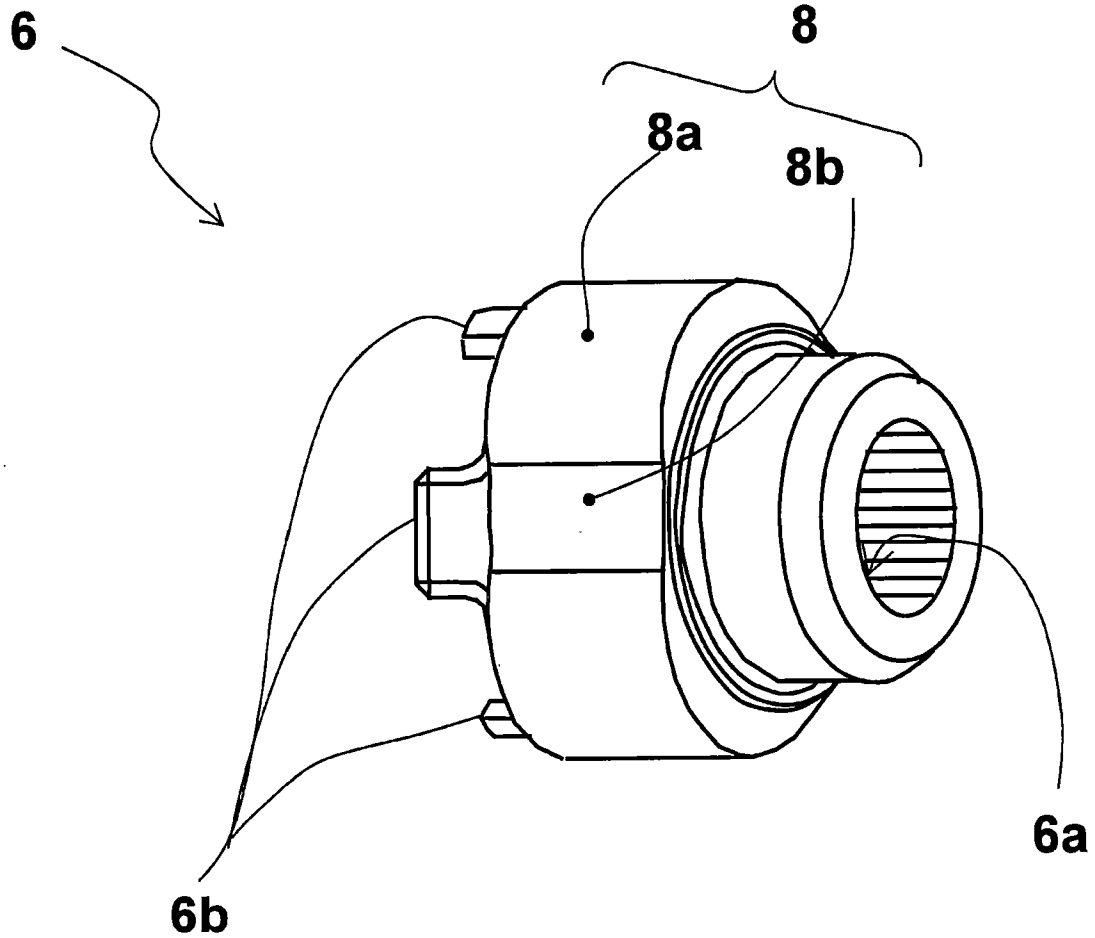
FIG. 4 is a perspective view of the pump cam member according to the illustrated embodiment.
Figure 5:
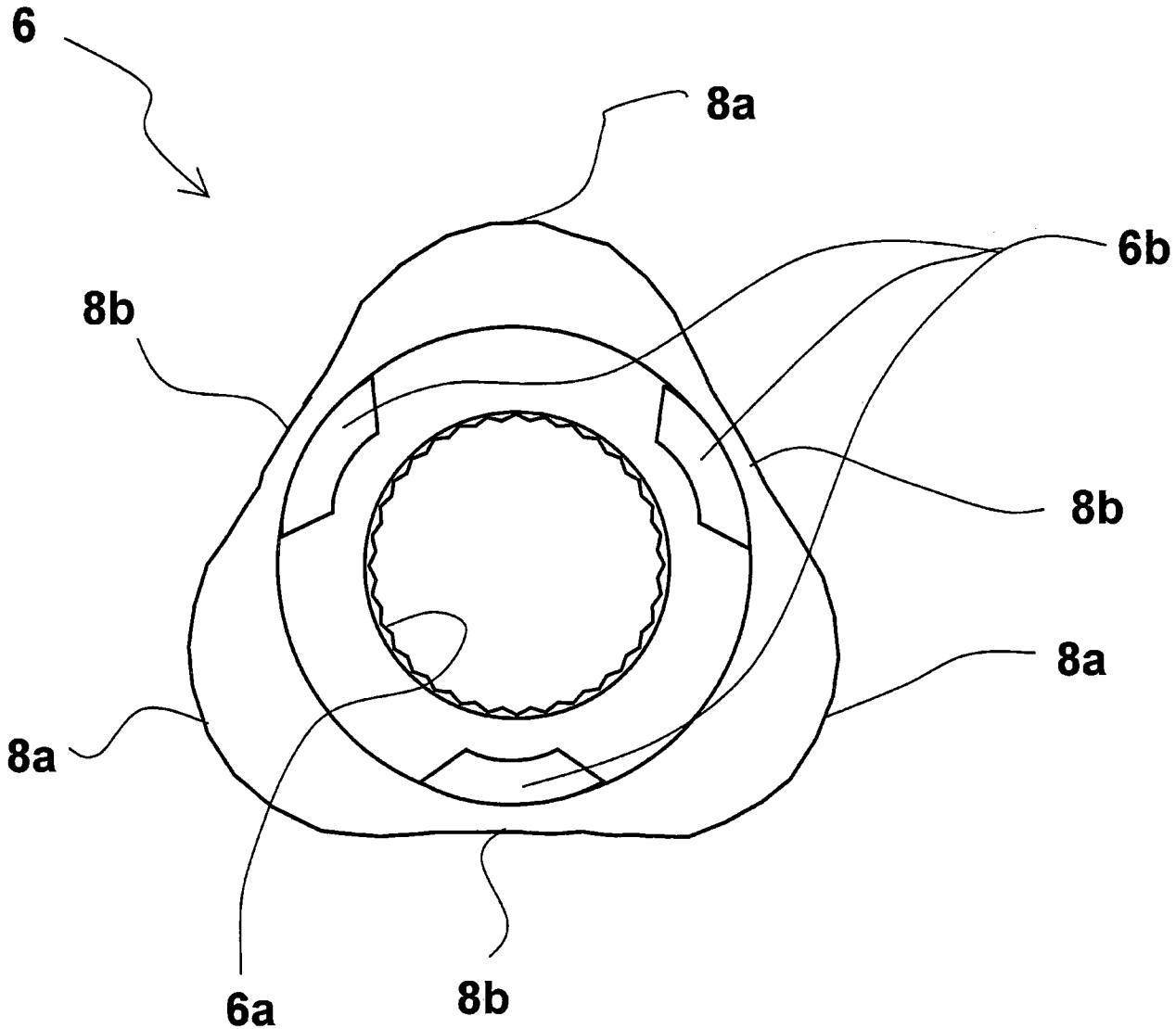
FIG. 5 is a frontal view of the pump cam member as seen from a contact protrusion according to the illustrated embodiment.
Figure 6:
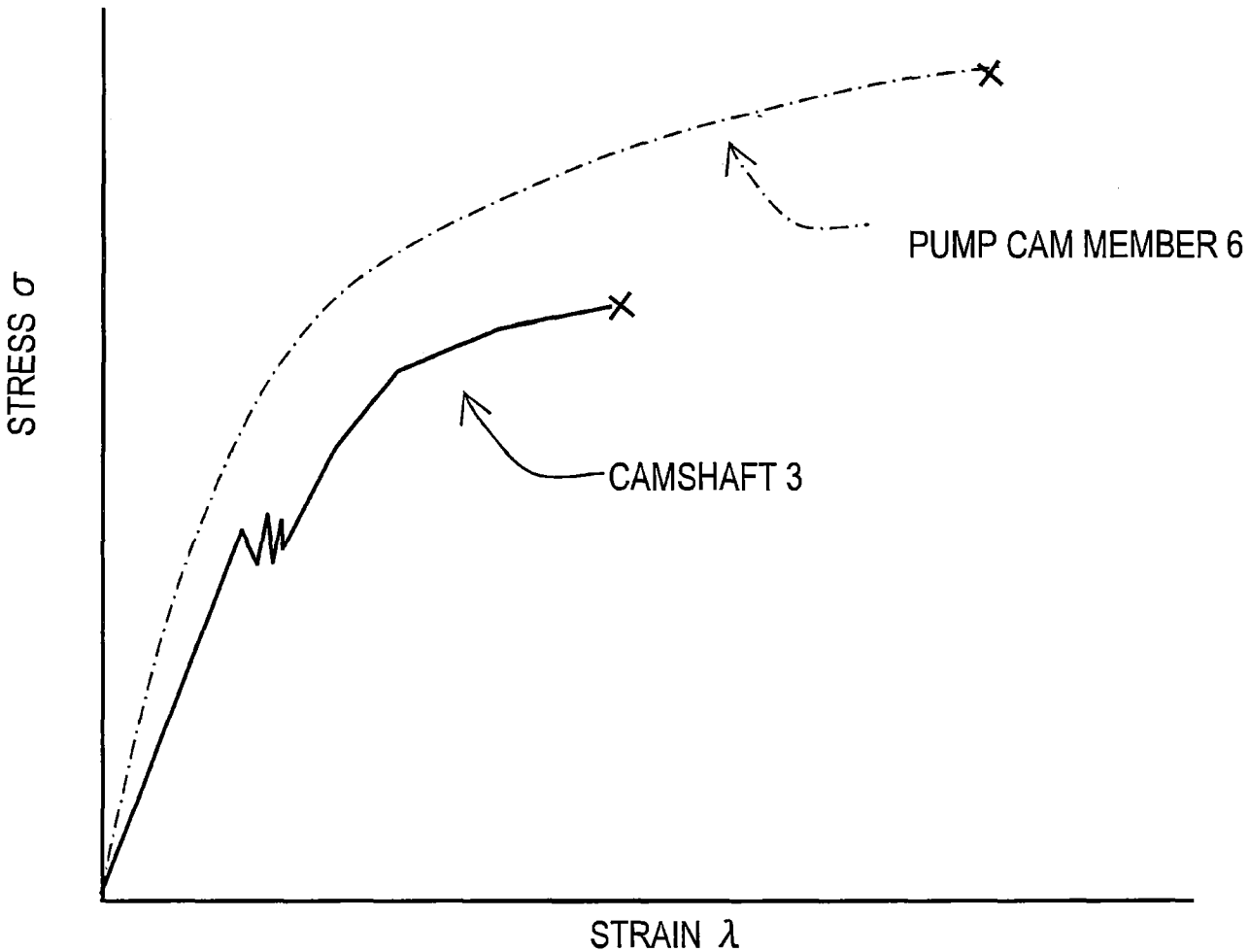
FIG. 6 is a stress-strain diagram showing a relationship between stress and strain in the camshaft and the pump cam member.

FIG. 4 is a perspective view of the pump cam member 6, and FIG. 5 is a frontal view showing the pump cam member 6 as viewed from a contact protrusion 6*b* (one example of the contact section). As shown in FIGS. 4 and 5, the pump cam member 6 is a rotary cam section serving to contact the plunger (not shown) of the high-pressure fuel pump 5 and drive the plunger reciprocally. The pump cam member 6 is made of, for example, a non-ferrous sintered metal material that has been subjected to austempering or another treatment to make it highly resistant to wear. FIG. 6 is stress-strain diagram expressing stress and strain relationships of the camshaft 3 and the pump cam member 6. Because the pump cam member 6 is made of a non-ferrous sintered metal material, the stress-strain characteristic exhibits no yield point before breakage occurs as shown in FIG. 6. Meanwhile, the stress-strain characteristic of the camshaft 3 has a yield point and breaks after it has passed through the yield point. The camshaft 3 exhibits a larger strain than the pump cam member 6 under the same stress.

The pump cam member 6 has a splined hole 6*a* (one example of a fitting hole) configured to have spline recesses inside. The pump cam member 6 also has a pump cam section 8 including a lift portion 8*a* that can drive the plunger of the high-pressure fuel pump 5 reciprocally and a base circular portion 8*b* that does not reciprocally drive the plunger of the high-pressure fuel pump 5. The lift portion 8*a* has a first lift portion, a second lift portion, and a third lift portion arranged with equal spacing around a circumference of the pump cam member 6. A base circular portion 8*b* is formed between the first lift portion and the second lift portion, between the second lift portion and the third lift portion, and between the third lift portion and the first lift portion.

As shown in FIGS. 4 and 5, three contact protrusions 6*b* (one example of the first to third protruding contact sections) are formed on an end face of the pump cam member 6 that faces the camshaft journal section 3*c*. The contact protrusions 6*b* are arranged in positions offset from the positions of the lift portions 8*a* in a circumferential direction, i.e., in positions corresponding to the positions where the base circular portions 8*b* are formed along the circumferential direction. The numbers of lift portions 8*a* and contact protrusions 6*b* are set based on requirements of the fuel pressurizing apparatus 20. Although three lift portions 8*a* and three contact protrusions 6*b* are provided in the illustrated embodiment, the number of the lift portion 8*a* and the contact protrusion 7*c* is not limited to three, and may be determined based on requirements for the fuel pressurizing apparatus 20, etc.

The press fitted state of a pump cam member 6 configured as explained above on the camshaft 3 will now be explained. A center axis of the axial splines of the axial spline section 3*d* of the extended section 30 of the camshaft 3 is coincident with an axial center of the splined hole 6*a* of the pump cam member 6. The pump cam member 6 is attached to the camshaft 3 by press fitting such that the splines of the axial spline section 3*d* engage with the spline recesses of the splined hole 6*a*. The press fit is made deep enough that the three contact protrusions 6*b* of the pump cam member 6 contact a step surface 3*e* of the camshaft journal section 3*c* of the camshaft 3.

Figure 7:
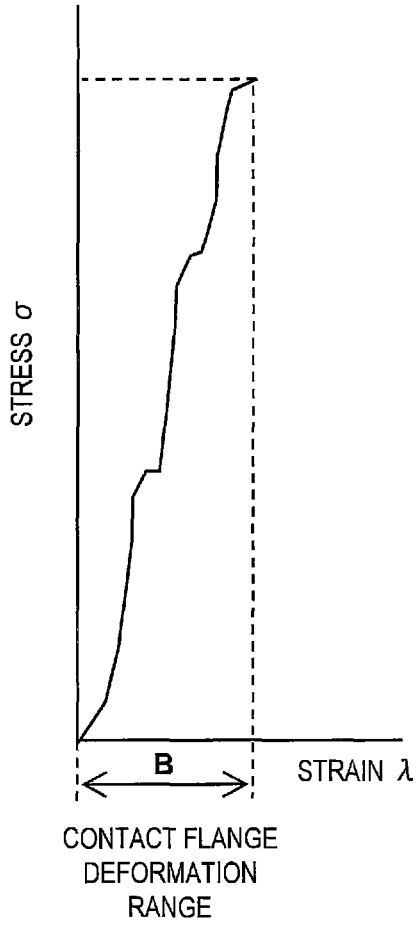
FIG. 7 is a diagram illustrating stress and strain at a contacting portion where the contact protrusion contacts a step surface according to the illustrated embodiment.

FIG. 7 illustrates a relationship of stress and strain of a portion of the step surface 3*e* where the contact protrusions 6*b* make contact from a point at which one of the contact protrusions 6*b* of the pump cam member 6 begins to contact the step surface 3*e* of the camshaft 3 as the axial spline section 3*d* of the camshaft 3 is inserted into the splined hole 6*a* of the pump cam member 6 to a point at which all three of the contact protrusions 6*b* of the pump cam member 6 contact the step surface 3*e* of the camshaft 3. The stress and strain at the portion of the step surface 3*e* that contacts the contact protrusions 6*b* do not change during an entire period from when insertion of the axial spline section 3*d* of the camshaft 3 into the splined hole 6*a* of the pump cam member 6 begins until when the step surface 3*e* of the camshaft 3 contacts any one of the three contact protrusions 6*b* of the pump cam member 6 contact the step surface 3*e* of the camshaft journal section 3*c* and press fitting is completed. As shown in FIG. 7, when one of the three contact protrusions 6*b* of the pump cam member 6 begins to touch the step surface 3*e* of the camshaft 3, the stress and strain both increase (elastic deformation region) and until eventually a yield point is reached and plastic deformation of the step surface 3*e* occurs. While one of the three contact protrusions 6*b* is causing elastic deformation or plastic deformation, one of the remaining two contact protrusions 6*b* begins to contact the step surface 3*e* followed by the last contact protrusion 6*b* such that all of the contacting portions transition from elastic deformation, pass through the yield point, and undergo plastic deformation. When plastic deformation is confirmed at the three locations where the contact protrusions 6*b* contact against the step surface 3*e*, the press fitting of the axial spline section 3*d* of the camshaft 3 into the splined hole 6*a* of the pump cam member 6 is finished. Confirming that plastic deformation has occurred at the contacting portions where the contact protrusions 6*b* contact the step surface 3*e* ensures that all of the contact protrusions 6*b* are well-seated against the step surface 3*e*. As a result, it is not necessary to machine a tip end surface of the contact protrusions 6*b* and precisely manage the amounts by which the three contact protrusions 6*b* protrude from an end face of the pump cam member 6. Thus productivity can be improved and machining costs can be suppressed.

Figure 8:
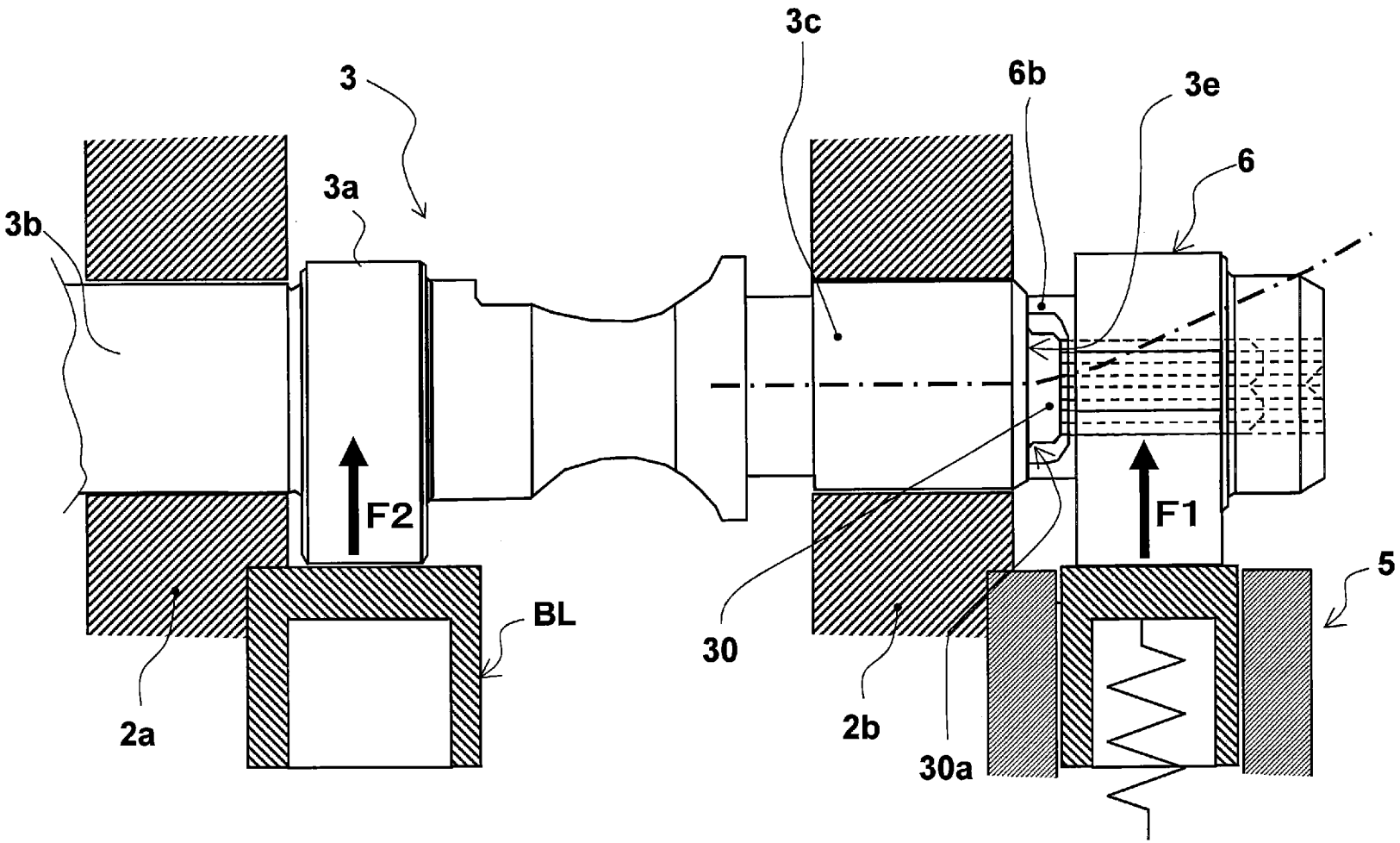
FIG. 8 schematically explains forces imparted to the camshaft and the pump cam member when the camshaft rotates.

Forces acting on the camshaft 3 and the pump cam member 6 during rotation of the camshaft 3 will now be explained. FIG. 8 is used to schematically explain forces acting on the camshaft 3 and the pump cam member 6 during rotation of the camshaft 3. The camshaft 3 is rotatably supported on the cylinder head 1 by means of the camshaft journal sections 3*b* and 3*c* being supported on the camshaft bearing sections 2*a* and 2*b*. Meanwhile, as shown in FIG. 8, the pump cam member 6 is supported in a cantilever arrangement in which only the camshaft journal section 3*c* is supported by the camshaft bearing section 2*b*. Thus, when the camshaft 3 rotates, the pump cam member 6 rotates as an integral unit with the camshaft 3 and a reaction force F1 resulting when the lift portions 8*a* of the pump cam member 6 drive the high-pressure fuel pump 5 acts on the camshaft 3. The reaction force F1 causes a bending force to act on a connecting portion 30*a* where the extended section 30 connects to the camshaft journal section 3*c* of the camshaft 3. Since the pump cam member 6 is configured such that the pump cam member 6 and the camshaft journal section 3*c* are closely adjacent to each other, the amount of protrusion from the camshaft journal section 3*c* is held to a minimum and, thus, a large reaction force F1 from a lift portion 8*a* of the pump cam member 6 can be supported with a cantilever arrangement. Also, since the three contact protrusions 6*b* of the pump cam member 6 contact the step surface 3*e* of the camshaft 3 at positions radially outward of the connecting portion 30*a*, the size of a bending force acting on the connecting portion 30*a* can be reduced in an effective manner.

In the fuel pressurizing apparatus 20 according to the embodiment explained heretofore, the pump cam member 6 and the camshaft 3 are formed as separate members. Consequently, the durability of the pump cam member 6 can be improved by adopting such measures as making the pump cam member 6 of a material that is highly resistant to wear and treating the pump cam member 6 with a special quenching process. Additionally, the pump cam member 6 is configured such that it can be arranged closely adjacent to the camshaft journal section 3*c* and such that an amount by which it protrudes from the pump cam member 6 can be supported in a cantilever fashion on the bearing section 2*b* and the apparatus can be made more compact.

When a reaction force of a lift portion 8*a* of the pump cam member 6 and causes a bending force to act on the connecting portion 30*a* where the extended section 30 of the camshaft 3 connects to the camshaft journal section 3*c*, bending deformation of the extended section 30 can be suppressed because the bending force is born by the three contact protrusions 6*b* at positions radially outward of the connecting section 30*a*. As a result, the pump cam member 6 can be prevented from tilting with respect to an axial centerline of the camshaft 3 and the service lives of both the pump cam member 6 and the camshaft 3 can be improved.

In this embodiment, the three contact protrusions 6*b* do not require any machining because the apparatus is structured such that the three contact protrusions 6*b* are pushed against the step surface 3*e* of the camshaft 3 until plastic deformation of the step surface 3*e* occurs.

Second Embodiment

Figure 9:
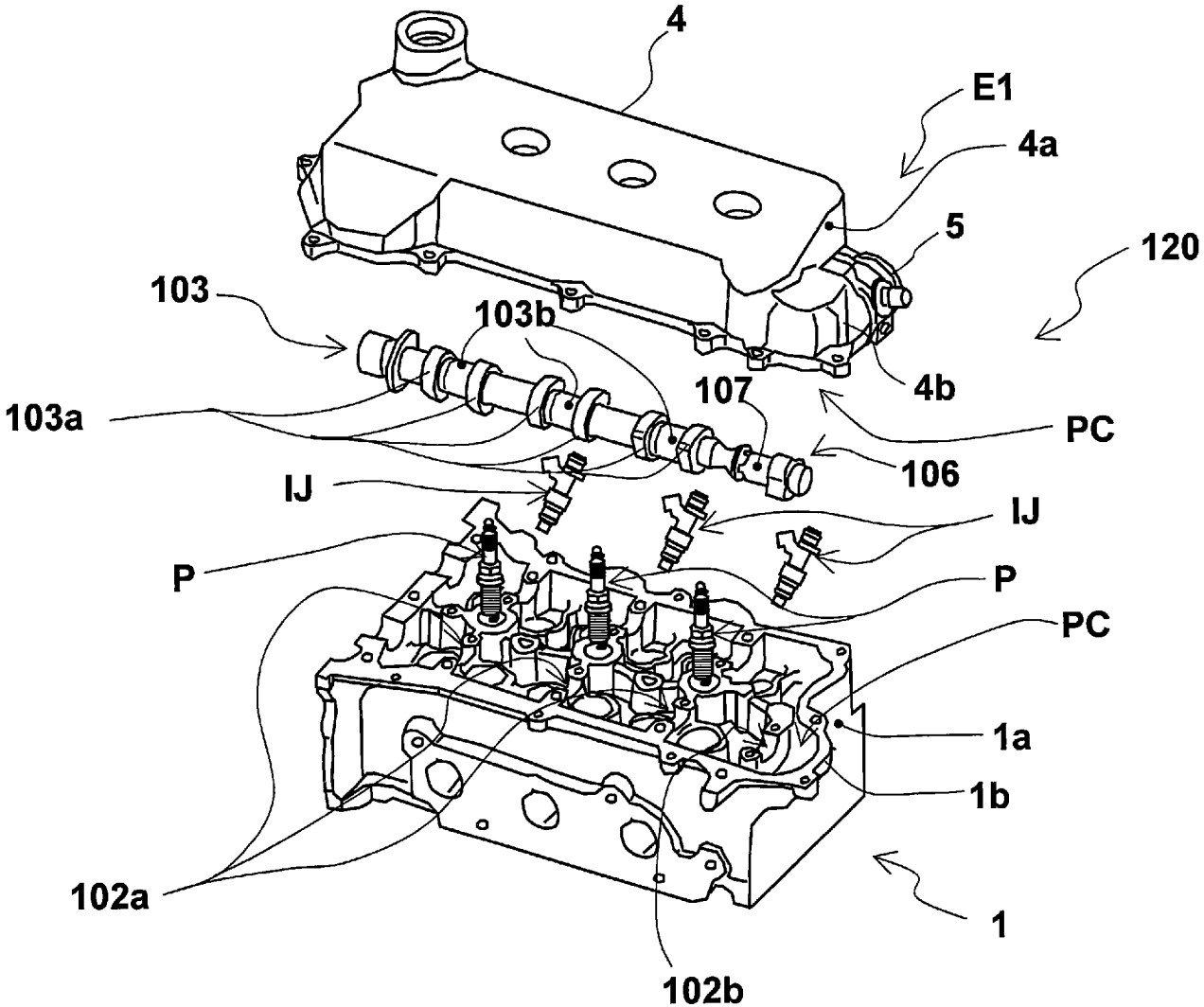
FIG. 9 is a diagrammatic view showing constituent features of an engine equipped with a fuel pressurizing device according to a second embodiment.
Figure 10:
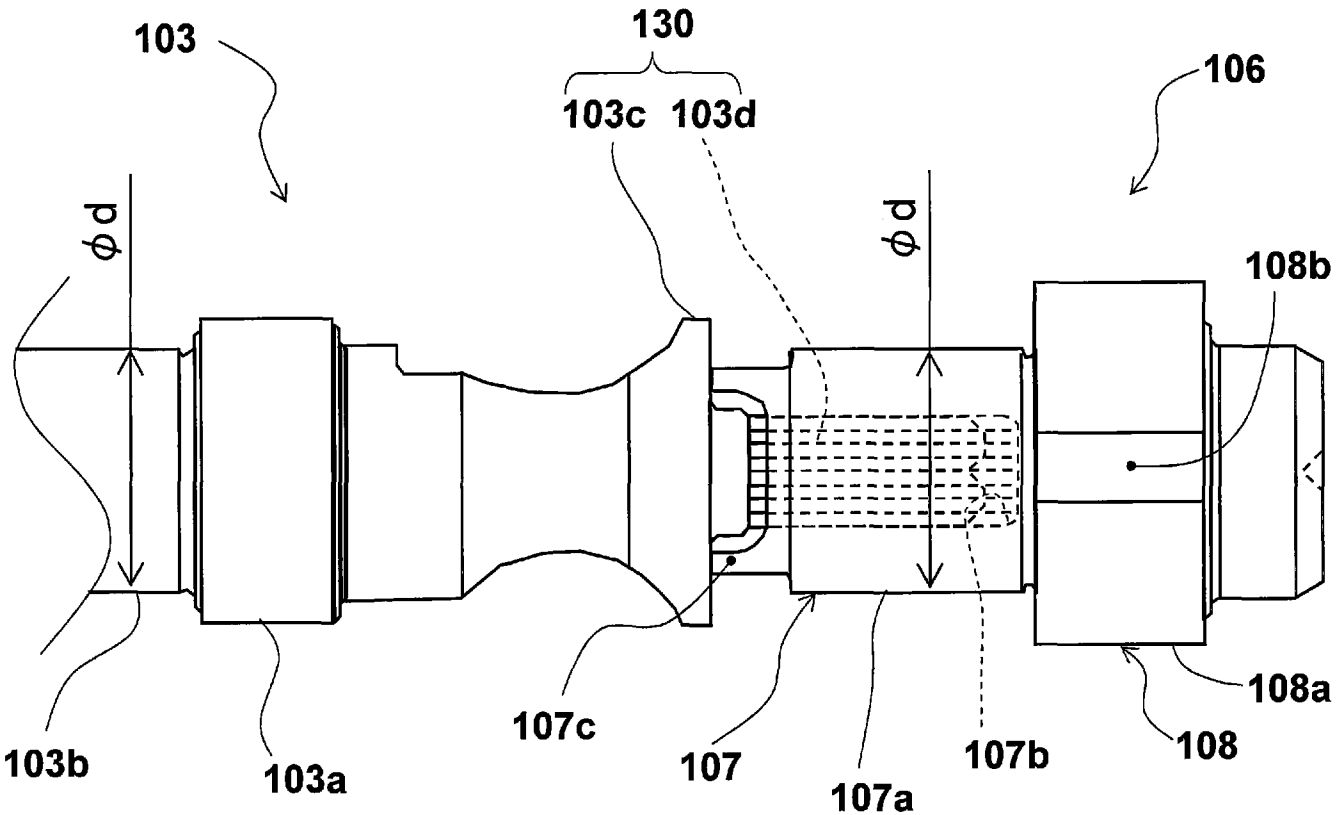
FIG. 10 is an enlarged view showing main features of a pump cam member 106 attached integrally to a tip end of a camshaft.
Figure 11:
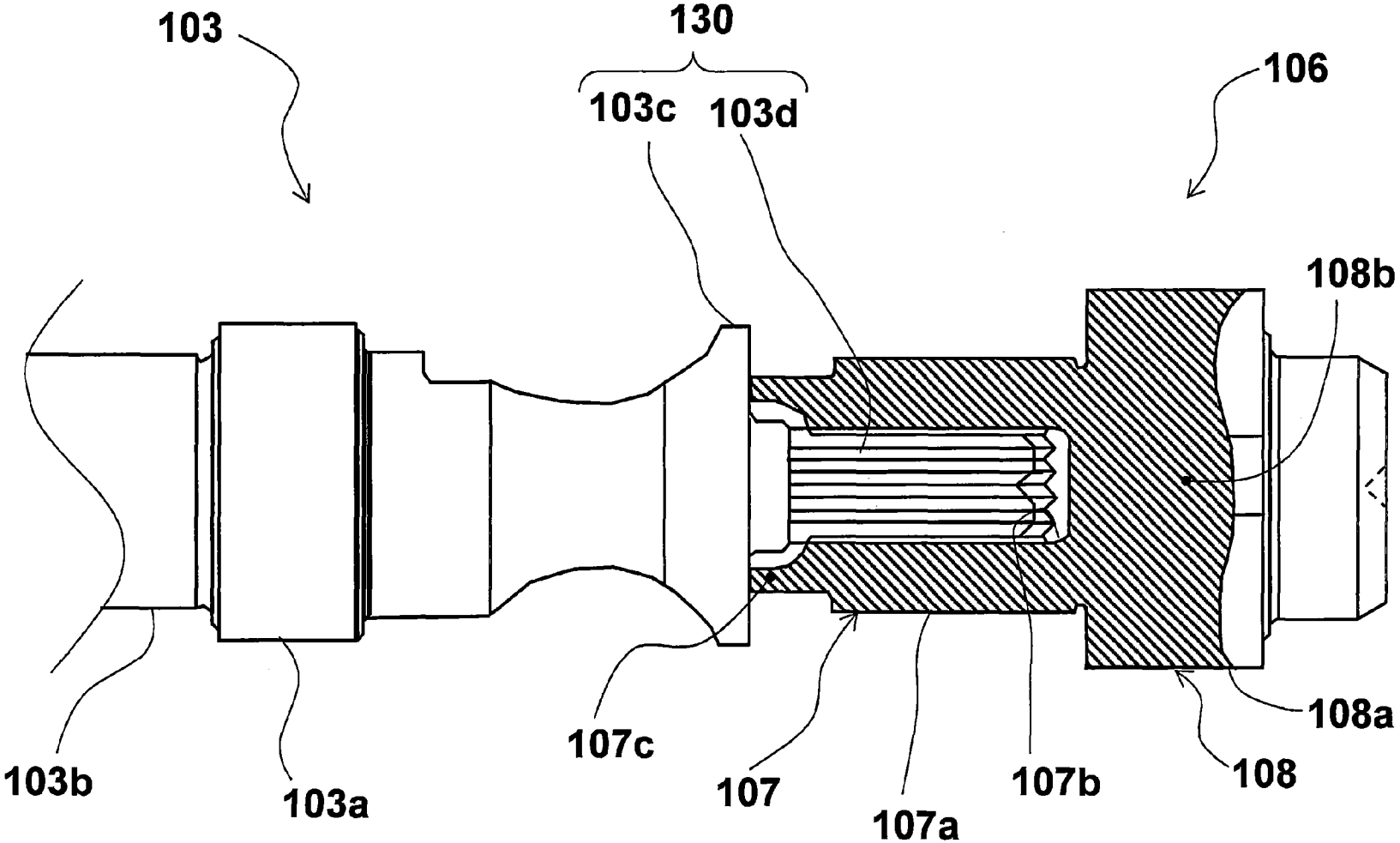
FIG. 11 is an enlarged view corresponding to FIG. 10 in which the pump cam member 106 is partially depicted with a cross sectional view.

An engine E equipped with a fuel pressurizing apparatus 120 equipped with a fuel pump driving structure according to a second embodiment of the present invention will now be explained. FIG. 9 is a diagrammatic view showing constituent features of an engine E1 equipped with the fuel pressurizing apparatus 120 having the fuel pump driving structure according to a second embodiment; FIG. 10 is an enlarged view showing a portion where a pump cam member 106 is press fitted a camshaft 103; and FIG. 11 is an enlarged view corresponding to FIG. 10 in which a portion is depicted with a cross sectional view. The engine E equipped with the fuel pressurizing apparatus 120 according to the second embodiment is the same as the engine E equipped with the fuel pressurizing apparatus 20 according to the first embodiment except that the fuel pressurizing apparatus 20 has been changed to the fuel pressurizing apparatus 120. Therefore, parts of the engine E of the second embodiment that are the same as the parts of the engine E of the first embodiment are indicated with the same reference numerals and explanations thereof are omitted for the sake of brevity.

As shown in FIG. 9, a fuel pressurizing apparatus 120 according to the second embodiment comprises a high-pressure fuel pump 5 attached to an end wall 4*a* of a head cover 4 that faces along a direction in which cylinders are arranged, a camshaft 103 rotatably supported on a cylinder head 1, and a pump cam member 106 fixed by press fitting onto one axial end of the camshaft 103. The camshaft 103 and the pump cam member 106 preferably constitute the fuel pump driving structure of this embodiment.

As shown in FIGS. 9, 10, and 11, the camshaft 103 comprises a plurality of cams 103*a* for opening and closing intake valves (not shown) and exhaust valves (not shown) and a camshaft journal section 103*b* supported on a camshaft bearing section 102*a*. The pump cam member 106 is fixed by press fitting onto one axial end of the camshaft 103 so as to be coaxial with respect to the camshaft 103. The camshaft 103 has an extended section 130 that extends beyond the cam 103*a* formed on an endmost portion of the camshaft 103 located toward one end along a direction in which the cylinders are arranged (right-hand side in FIG. 9). The extended section 130 comprises a contact flange section 103*c* (one example of the bulged section) where a diameter of the camshaft 103 increases after briefly decreasing as one moves from the endmost cam 103*a* toward a tip end of the camshaft 103 and an axial spline section 103*d* that has a smaller diameter than the contact flange section 103*c* and has splines formed on an external circumferential surface thereof. The camshaft 103 is made of cast iron, e.g., nodular cast iron.

Figure 12:
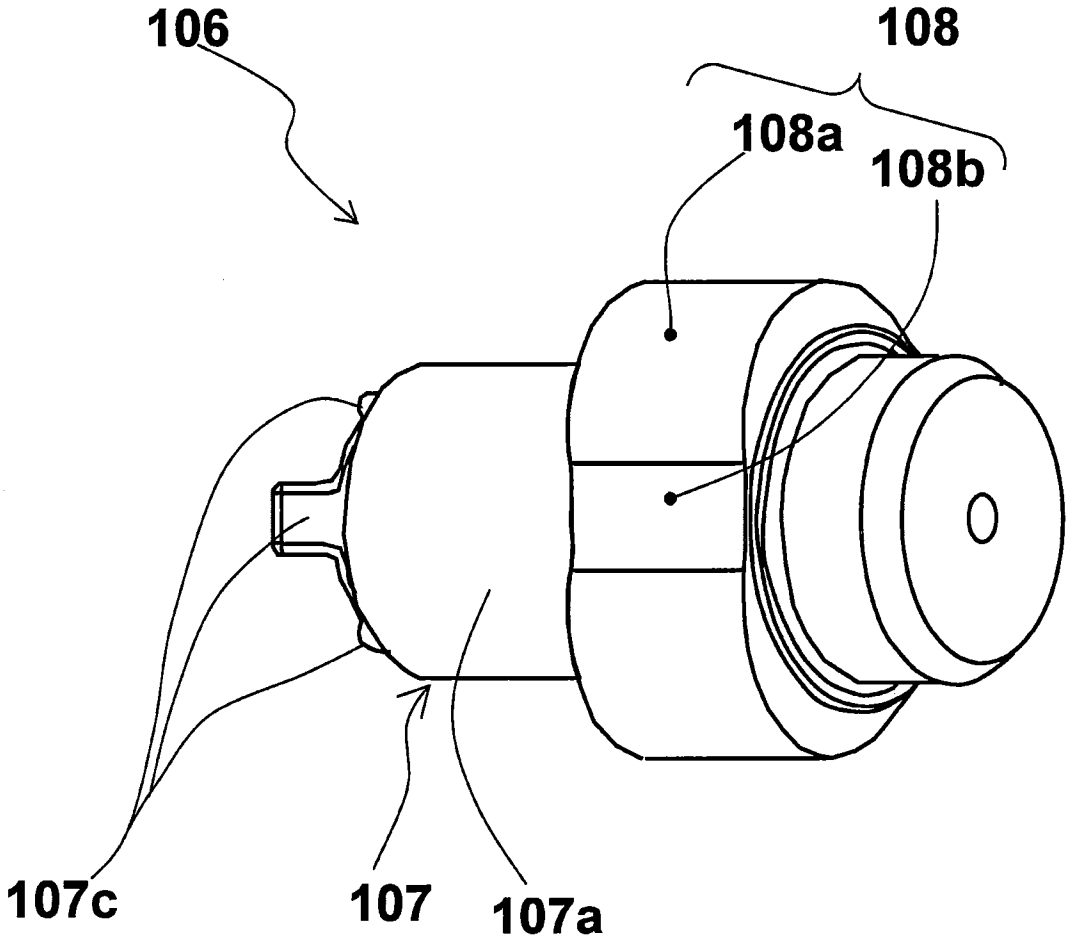
FIG. 12 is a perspective view of the pump cam member.
Figure 13:
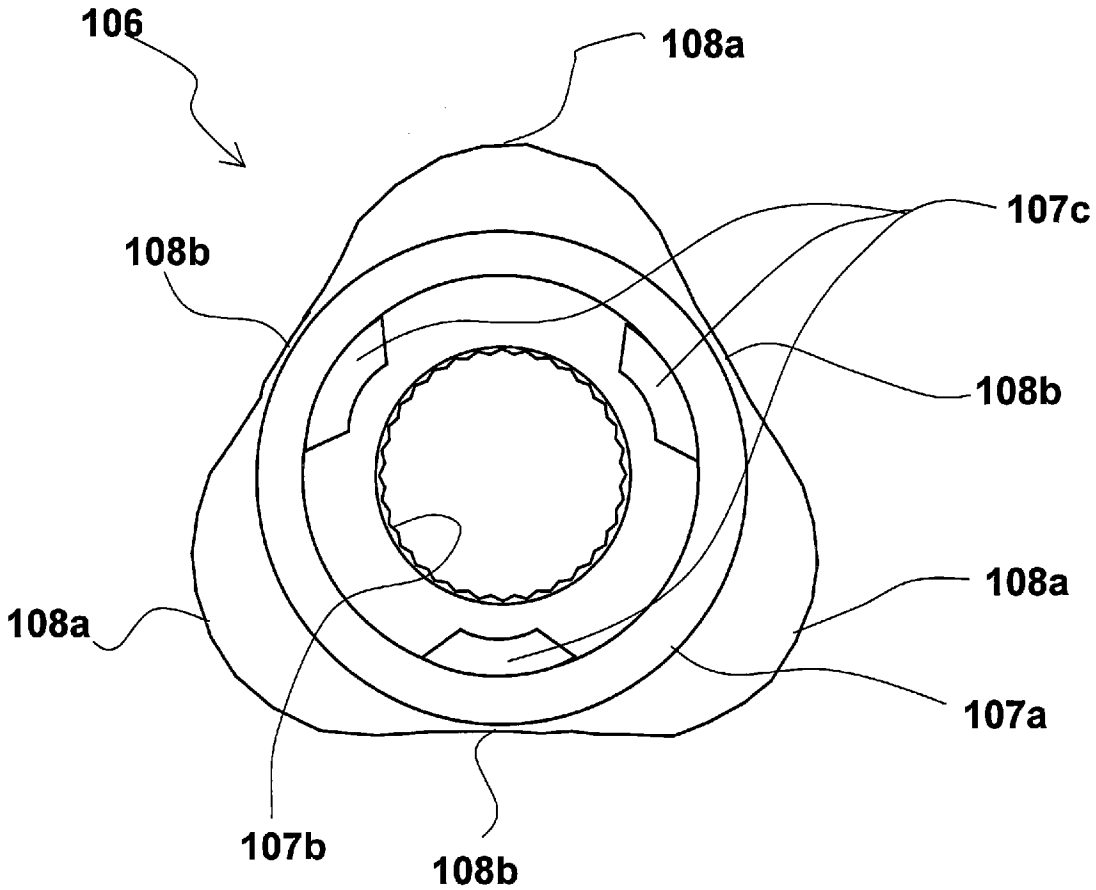
FIG. 13 is a frontal view of the pump cam member as seen from a contact protrusion.

FIG. 12 is a perspective view of the pump cam member 106, and FIG. 13 is a frontal view showing the pump cam member 106 as viewed from a contact protrusion 107*c*. As shown in FIGS. 12 and 13, the pump cam member 106 comprises a pump cam section 108 and a boss section 107. The pump cam section 108 contacts a plunger of the high-pressure fuel pump 5 and serves to drive the plunger reciprocally, and the boss section 107 is formed as a one-piece integral unit with the pump cam section 108 so as to be closely adjacent to and coaxial with respect to the pump cam section 108. The pump cam member 106 is made of, for example, a non-ferrous sintered metal material that has been subjected to austempering or another treatment to make it highly resistant to wear. Similarly to a fuel pressurizing apparatus 20 according to the first embodiment, in a fuel pressurizing apparatus 120 according to the second embodiment the stress-strain characteristic of the pump cam member 106 exhibits no yield point until breakage occurs (see FIG. 6) because the pump cam member 106 is made of a non-ferrous sintered metal material. Meanwhile, the stress-strain characteristic of the camshaft 103 has a yield point and breaks after it has passed through the yield point (see FIG. 6). The camshaft 103 exhibits a larger strain than the pump cam member 106 under the same stress.

The pump cam section 108 has a lift portion 108*a* that can drive the plunger of the high-pressure fuel pump 5 reciprocally and a base circular portion 108*b* that does not reciprocally drive the plunger of the high-pressure fuel pump 5. The lift portion 108*a* has a first lift portion, a second lift portion, and a third lift portion arranged with equal spacing around a circumference of the pump cam section 108. A base circular portion 108*b* is formed between the first lift portion and the second lift portion, between the second lift portion and the third lift portion, and between the third lift portion and the first lift portion.

An external circumferential surface of the boss section 107 is configured to serve as a pump cam journal section 107*a* supported on the pump cam bearing section 102*b* formed on the cylinder head 1, and a splined hole 107*b* (one example of a fitting hole) having spline recesses is formed inside the boss section 107. The pump cam journal section 107*a* is configured to have substantially the same diameter as the camshaft journal section 103*b* of the camshaft 103. As a result, the camshaft bearing section 102*a* and the pump cam bearing sections 102*b* of the cylinder head 1 can be machined at the same time with the same tool and a manufacturing efficiency can be improved. Also, as shown in FIGS. 12 and 13, three contact protrusions 107*c* (one example of the contact section) are formed on an end face of the boss section 107 on an opposite side of the boss section 107 as a side where the pump cam section 108 is formed, and the contact protrusions 107*c* protrude in the opposite direction as the side on which the pump cam section 108 is formed. The contact protrusions 107*c* are arranged in positions offset from the positions of the lift portions 108*a* in a circumferential direction, i.e., in positions corresponding to the positions where the base circular portions 8*b* are formed along the circumferential direction.

The press fitted state of a pump cam member 106 (configured as explained above) on the camshaft 103 will now be explained. A center axis of the axial spline section 103*d* of the extended section 130 of the camshaft 103 is coincident with an axial center of the splined hole 107*b* of the pump cam member 106. The pump cam member 106 is attached to the camshaft 103 by press fitting such that the splines of the axial spline section 103*d* engage with the spline recesses of the splined hole 107*b*. The press fit is made deep enough that the three contact protrusions 107*c* of the pump cam member 106 contact the contact flange 103*c* of the camshaft 103.

FIG. 7 illustrates a relationship of stress and strain of a portion of the contact flange 103*c* that contacts the contact protrusions 107*c*. Similarly to the fuel pressurizing apparatus 20 of the first embodiment, the stress and strain at the portion of the contact flange 103*c* that contacts the contact protrusions 107*c* do not change during an entire period from a point at which insertion of the axial spline section 103*d* of the camshaft 103 into the splined hole 107*b* of the pump cam member 106 begins to a point at which any one of the three of the contact protrusions 107*c* of the pump cam member 106 contacts the contact flange 103*c* of the camshaft 103. However, when one of the three contact protrusions 107*c* of the pump cam member 106 begins to touch the contact flange 103*c* of the camshaft 103, the stress and strain both increase (elastic deformation region) and until eventually a yield point is reached and plastic deformation of the contact flange 103*c* occurs. While one of the three contact protrusions 107*c* is causing elastic deformation or plastic deformation, one of the remaining two contact protrusions 107*c* begins to contact the contact flange 103*c* followed by the last contact protrusion 107*c* such that all of the contacting portions transition from elastic deformation, pass through the yield point, and undergo plastic deformation. When plastic deformation is confirmed at the three locations where the contact protrusions 107*c* contact against the contact flange 103*c*, the press fitting of the axial spline section 103*d* of the camshaft 103 into the splined hole 107*b* of the pump cam member 106 is finished. Confirming that plastic deformation has occurred at the contacting portions where the contact protrusions 107*c* contact the contact flange 103*c* ensures that all of the contact protrusions 107*c* are well-seated against the contact flange 103*c*. As a result, it is not necessary to machine a tip end surface of the contact protrusions 107*c* and precisely manage the amounts by which the three contact protrusions 107*c* protrude from an end face of the boss section 107. Thus, productivity can be improved and machining costs can be suppressed.

Figure 14:
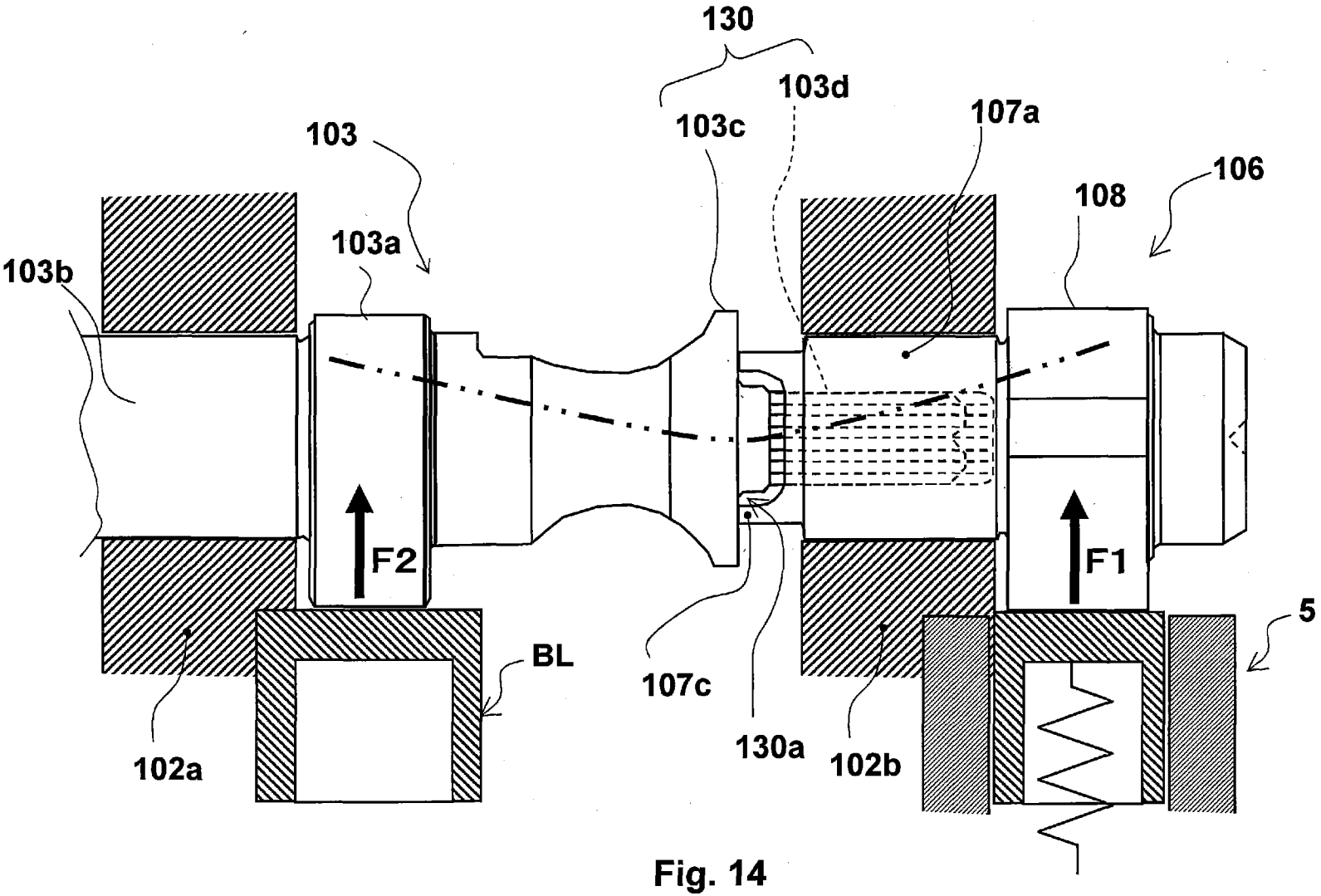
FIG. 14 illustrates forces imparted to the camshaft and the pump cam member when the camshaft rotates.

Forces acting on the camshaft 103 and the pump cam member 106 during rotation of the camshaft 103 will now be explained. FIG. 14 illustrates forces acting on the camshaft 103 and the pump cam member 106 during rotation of the camshaft 103. The camshaft 103 is rotatably supported on the cylinder head 1 by means of the camshaft journal sections 103*b* being supported on a plurality of camshaft bearing sections 102*a* and the extended section 130 being supported by the pump cam bearing section 102*b* through the pump cam journal section 107*a* of the pump cam member 106. Meanwhile, as shown in FIG. 14, the pump cam member 106 is supported in a cantilever arrangement in which only the pump cam journal section 107*a* is supported by the pump cam bearing section 102*b* and the side where pump cam section 108 is located is a free end. Thus, when the camshaft 103 rotates, the pump cam member 106 rotates as an integral unit with the camshaft 103, a reaction force F1 resulting when the pump cam section 108 drives the high-pressure fuel pump 5 acts on the pump cam member 106, and a reaction force F2 resulting when a cam 103*a* drives a valve lifter BL acts on the camshaft 103. The reaction forces F1 and F2 cause the pump cam member 106 and the camshaft 103 to undergo a substantially V-shaped bending deformation (see double-dot chain line in FIG. 14) having an inflection point located near a connecting portion 130*a* where contact flange section 103*c* and the axial spline section 103*d* of the extended section 130 connect to each other. Since the pump cam member 106 is configured such that the pump cam section 108 and the boss section 107 (pump cam journal section 107*a*) are closely adjacent to each other and formed as a one-piece integral unit, the amount of protrusion from the pump cam journal section 107*a* is held to a minimum and, thus, a large reaction force F1 from the pump cam section 108 can be supported with a cantilever arrangement. Also, since the three contact protrusions 107*c* of the pump cam member 106 contact the contact flange 103*c* of the camshaft 103 at positions radially outward of the connecting portion 130*a*, the bending deformation having an inflection point near the connecting portion 130*a* can be suppressed in an effective manner.

In the fuel pressurizing apparatus 120 according to the second embodiment explained heretofore, the pump cam member 106 and the camshaft 103 are formed as separate members. Consequently, the durability of the pump cam section 108 can be improved by adopting such measures as making the pump cam member 106 of a material that is highly resistant to wear and treating the pump cam member 106 with a special quenching process. As shown in FIG. 14, a plurality of camshaft journal sections 103*b* of the camshaft 103 are rotatably supported on a camshaft bearing section 102*a* of the cylinder head 1 and the journal section 107*a* of the pump cam member 106 is rotatably supported on the bearing section 102*b*. Meanwhile, the pump cam member 106 is configured such that the pump cam section 108 and the boss section 107 are closely adjacent to each other and formed as a one-piece integral unit. As a result, when the pump cam journal section 107*a* is supported on the bearing section 102*b* of the cylinder head, the distance from the pump cam journal section 107*a* to the pump cam section 108 is small and the pump cam section 108 can be supported in a cantilever fashion at the bearing section 102*b*.

When the reaction forces of the pump cam section 108 and the cam 103*a* cause the camshaft 103 and the pump cam member 106 to deform as shown in FIG. 14, the reaction force F1 resulting at a lift portion 108*a* of the pump cam section 108 when the pump cam section 108 drives the high-pressure fuel pump 5 and the reaction force F2 resulting at the cam 103*a* of the camshaft 103 when the cam 103*a* drives the valve lifter BL can be born by the three contact protrusions 107*c*. As a result, the pump cam member 106 can be prevented from tilting with respect to the camshaft 103 and the service lives of both the pump cam section 108 and the camshaft 103 can be improved.

A reaction force F1 from a lift portion 108*a* can be born in a more stable fashion because the three contact protrusions 107*c* are configured to abut against the contact flange section 103*c*, which bulges radially outward from the camshaft 103. Also, since the three contact protrusions 107*c* are arranged with equal spacing in-between, the reaction forces from each of the lift portions 108*a* can be born reliably.

Since the diameter of the pump cam journal section 107*a* of the pump cam member 106 and the diameters of the camshaft journal sections 103*b* of the camshaft 3 are substantially the same, the camshaft bearing sections 102*a* and the bearing section 102*b* of the cylinder head 1 can be machined at the same time.

In this embodiment, the three contact protrusions 107*c* do not require any machining because the apparatus is structured such that the three contact protrusions 107*c* are pushed against the contact flange section 103*c* of the camshaft 103 until plastic deformation of the contact flange section 103*c* occurs.

Accordingly, with the fuel pump driving structure according to one aspect of the illustrated embodiment, the pump cam member and the camshaft are formed as separate members. Consequently, it is easy to take measures to improve the durability of the pump cam section, such as making the pump cam member of a material that is highly wear resistant and treating the pump cam member with a special quenching process. Additionally, since the pump cam member is press fitted onto one end of the camshaft, a distance from a bearing section to the pump cam member can be shortened and the pump cam member can be supported in a cantilever fashion such that the apparatus can be made more compact. Also, when the pump cam member is press fitted onto one end of the camshaft, the contact section of the pump cam member contacts the camshaft in an axial direction at a position that is aligned with the lift portion in a circumferential direction and radially outward of an external circumferential surface of the one end of the camshaft. Thus, a bending force imparted to the one end of the camshaft due to a reaction force from the lift portion of the pump cam member can be born by the contact section and the load born by the camshaft can be reduced. As a result, the service life of the camshaft and the pump cam member can be improved while also making the apparatus more compact.

In the fuel pump driving structure according to another aspect, the one end of the camshaft has a journal section configured to be supported directly on the bearing section and an extended section having a smaller diameter than the journal section and arranged to extend from the journal section in a step like fashion. The contact section contacts the camshaft on a step surface that joins an external circumferential surface of the journal section with an external circumferential surface of the extended section. In this way, it is easy to secure a structure in which the contact section of the pump cam member contacts a portion of the camshaft in an axial direction at a position radially outward of an external circumferential surface of said one end of the camshaft.

In the fuel pump driving structure according to another aspect, spline protrusions are formed on an external circumference of the extended section and spline recesses corresponding to the spline protrusions are formed in the fitting hole such that the pump cam member and the camshaft can be joined together as an integral unit with a splined press fit. With this aspect, the pump cam member and the camshaft can be joined together reliably as an integral unit using a simple structure.

In the fuel pump driving structure according to another aspect, the pump cam member has a boss section that is formed closely adjacent to and integrally with a pump cam comprising the lift portion and the base circular portion and a journal section configured to be supported on the bearing section is formed on an external circumference of the boss section. The one end of the camshaft is supported indirectly on the bearing section through the journal section of the pump cam member. With this aspect, a larger insertion amount can be secured between the pump cam member and the camshaft and a distance from the bearing section to the pump cam member can be shortened.

In the fuel pump driving structure according to another aspect, the contact section protrudes in an axial direction from an end face of the boss section located on the opposite side of the boss section as the pump cam. With this aspect, it is easy to achieve a structure in which the contact section of the pump cam member contacts a portion of the camshaft in an axial direction at a position radially outward of an external circumferential surface of the one end of the camshaft.

In the fuel pump driving structure according to another aspect, the camshaft is configured to have a bulged section where it expands outward in a radial direction and the contact section is configured to contact the bulged section. With this aspect, since the contact section contacts the camshaft at a bulged section configured to expand radially outward, a reaction force from the lift portion can be born in a stable manner.

In the fuel pump driving structure according to the illustrated embodiment, the camshaft has a camshaft journal section that is formed on a portion of the camshaft other than the one end and configured and arranged to be supported by a bearing section of the cylinder head. Also, the pump camshaft journal portion of the boss section of the pump cam member has a diameter that is substantially the same as a diameter of the camshaft journal section. With this aspect, machining of the bearing section of the cylinder head serving to support the cam journal section of the camshaft and machining of the bearing section of the cylinder head serving to support the journal section of the pump cam member can be conducted simultaneously. As a result, the machining productivity can be improved.

In the fuel pump driving structure according to another aspect, spline protrusions are formed on an external circumference of the other end of the camshaft and spline recesses corresponding to the spline protrusions are formed in the fitting hole such that the pump cam and the camshaft can be joined together as an integral unit with a splined press fit. With this aspect, the pump cam member and the camshaft can be joined together reliably as an integral unit using a simple structure.

In the fuel pump driving structure according to another aspect, a plurality of said lift portion is provided and the lift portions are arranged with equal spacing around a circumference of the pump cam member. Also, a plurality of said contact section is provided and the contact sections are arranged in positions offset from positions of each of the lift portions in a circumferential direction. With this aspect, reaction forces from the lift portions can be born by the contact sections.

An internal combustion engine according to the illustrated embodiment includes a fuel injection section and a spark ignition section. The fuel injection section is configured to inject fuel that has been pressurized by the high-pressure fuel pump with the fuel pump driving structure as described above into a combustion chamber. The spark ignition section is configured to ignite an air-fuel mixture containing fuel injected into the combustion chamber. When the air-fuel mixture is ignited by the spark ignition section, a combustion energy of the air-fuel mixture causes a piston to move reciprocally and the reciprocal motion of the piston is converter into rotational motion of a crankshaft.

An internal combustion engine according to any one of the illustrated embodiments is provided with an internal combustion engine fuel pressurizing apparatus operatively coupled to the fuel pump driving structure according to any one of the aspects of the invention explained above and, thus, exhibits the effects as described above. For example, the service life of the camshaft and the pump cam can be improved because the apparatus can be made more compact. As a result, the fuel efficiency of an automobile can be improved.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment, the following directional terms "above", "downward", "vertical", "horizontal", and "below" as well as any other similar directional terms refer to those directions of an internal combustion engine when the internal combustion engine is oriented as shown in FIG. 1. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

The invention claimed is:

1. A fuel pump driving structure configured to drive a high-pressure fuel pump of an internal combustion engine, the fuel pump driving structure comprising:

a camshaft configured and arranged to be rotatably supported at an end by a cylinder head of the internal combustion engine; and a pump cam member having an internal circumference surface defining a fitting hole into which the end of the camshaft is press fitted, and configured to be operatively coupled to the high-pressure fuel pump to drive the high-pressure fuel pump, the pump cam member including a pump cam section having a first lift portion configured to operate the high-pressure fuel pump, and a base circular portion configured so as to not operate the high-pressure fuel pump, and a first contact section arranged in a position offset from a position of the first lift portion with respect to a circumferential direction, and contacting a portion of the camshaft in an axial direction of the camshaft at a position radially outward of an external circumferential surface of the one end of the camshaft so as to reduce bending of the camshaft where the pump cam member is mounted.

2. The fuel pump driving structure recited in claim 1, wherein the end of the camshaft has a camshaft journal section configured and arranged to be supported directly by a camshaft bearing section of the cylinder head, and an extended distal end section extending from the camshaft journal section and having a diameter smaller than a diameter of the camshaft journal section such that a step surface is between an external circumferential surface of the camshaft journal section and an external circumferential surface of the extended distal end section, and the first contact section contacts the step surface.

3. The fuel pump driving structure recited in claim 2, wherein the external circumference surface of the extended distal end section of the camshaft includes spline protrusions, and the internal circumference surface of the pump cam member includes spline recesses corresponding to the spline protrusions of the camshaft so that the pump cam member and the camshaft are fixedly joined together with a splined press fit.

4. The fuel pump driving structure recited in claim 1, wherein the pump cam member further includes a boss section disposed adjacent to the pump cam section with an external circumference surface of the boss section forming a pump cam journal portion so that the end of the camshaft is indirectly supported on a pump cam bearing section of the cylinder head via the pump cam journal portion, the boss section and the pump cam section being integrally formed as a one-piece, unitary member.

5. The fuel pump driving structure recited in claim 4, wherein the first contact section protrudes in the axial direction from a surface of the boss section disposed on an opposite side from the pump cam section.

6. The fuel pump driving structure recited in claim 4, wherein the camshaft includes a bulged section expanding outward in a radial direction, and the first contact section contacts an axial end surface of the bulged section of the camshaft.

7. The fuel pump driving structure recited in claim 4, wherein the camshaft has a camshaft journal section arranged axially adjacent to the end of the camshaft, the camshaft journal section being configured and arranged to be supported by a camshaft bearing section of the cylinder head, and the pump cam journal portion of the boss section has a diameter substantially equal to a diameter of the camshaft journal section of the camshaft.

8. The fuel pump driving structure recited in claim 4, wherein the external circumference surface of the end of the camshaft includes spline protrusions, and the internal circumference surface of the pump cam member includes spline recesses corresponding to the spline protrusions of the camshaft so that the pump cam member and the camshaft are fixedly joined together with a splined press fit.

9. The fuel pump driving structure recited in claim 1, wherein the pump cam section further includes a second lift portion and a third lift portion with the first, second and third lift portions being disposed with equal spacing around a circumference of the pump cam section, and the pump cam member further includes a second contact section and a third contact section arranged in positions offset from positions of the second lift portion and the third lift portion, respectively, with respect to the circumferential direction.

10. An internal combustion engine including the fuel pump driving structure recited in claim 1, and configured to convert reciprocating motion of a piston due to a combustion energy generated by explosive combustion of an air-fuel mixture into a rotational movement of a crankshaft, the internal combustion engine comprising:

the high-pressure fuel pump operatively coupled to the fuel pump driving structure;

a fuel injection section configured and arranged to inject fuel that has been pressurized by the high-pressure fuel pump with the fuel pump driving structure into a combustion chamber; and a spark ignition section configured and arranged to spark-ignite the air-fuel mixture including the fuel injected by the fuel injection section in the combustion chamber to cause the explosive combustion of the air-fuel mixture.

11. The fuel pump driving structure recited in claim 5, wherein the camshaft includes a bulged section expanding outward in a radial direction, and the first contact section contacts an axial end surface of the bulged section of the camshaft.

12. The fuel pump driving structure recited in claim 5, wherein the camshaft has a camshaft journal section arranged axially adjacent to the end of the camshaft, the camshaft journal section being configured and arranged to be supported by a camshaft bearing section of the cylinder head, and the pump cam journal portion of the boss section has a diameter substantially equal to a diameter of the camshaft journal section of the camshaft.

13. The fuel pump driving structure recited in claim 6, wherein the camshaft has a camshaft journal section arranged axially adjacent to the end of the camshaft, the camshaft journal section being configured and arranged to be supported by a camshaft bearing section of the cylinder head, and the pump cam journal portion of the boss section has a diameter substantially equal to a diameter of the camshaft journal section of the camshaft.

14. The fuel pump driving structure recited in claim 7, wherein the external circumference surface of the end of the camshaft includes spline protrusions, and the internal circumference surface of the pump cam member includes spline recesses corresponding to the spline protrusions of the camshaft so that the pump cam member and the camshaft are fixedly joined together with a splined press fit.

15. The fuel pump driving structure recited in claim 8, wherein the pump cam section further includes a second lift portion and a third lift portion with the first, second and third lift portions being disposed with equal spacing around a circumference of the pump cam section, and the pump cam member further includes a second contact section and a third contact section arranged in positions offset from positions of the second lift portion and the third lift portion, respectively, with respect to the circumferential direction.

16. An internal combustion engine including the fuel pump driving structure recited in claim 9, and configured to convert reciprocating motion of a piston due to a combustion energy generated by explosive combustion of an air-fuel mixture into a rotational movement of a crankshaft, the internal combustion engine comprising:

the high-pressure fuel pump operatively coupled to the fuel pump driving structure;

a fuel injection section configured and arranged to inject fuel that has been pressurized by the high-pressure fuel pump with the fuel pump driving structure into a combustion chamber; and a spark ignition section configured and arranged to spark-ignite the air-fuel mixture including the fuel injected by the fuel injection section in the combustion chamber to cause the explosive combustion of the air-fuel mixture.

* * * * *